US005384509A

United States Patent [19]

Kane et al.

[11] Patent Number: 5,384,509

[45] Date of Patent: Jan. 24, 1995

[54] FIELD EMISSION DEVICE WITH HORIZONTAL EMITTER

[75] Inventors: Robert C. Kane, Woodstock, Ill.; Kevin B. Hilgers, Mesa, Ariz.

[73] Assignee: Motorola, Inc., Schaumburg, Ill.

[21] Appl. No.: 732,297

[22] Filed: Jul. 18, 1991

[51] Int. Cl.[6] ..... H01J 19/24

[52] U.S. Cl. ..... 313/309; 313/308; 313/336; 313/351; 313/355

[58] Field of Search ..... 313/309, 308, 336, 351, 313/355; 315/169.4; 345/37, 39, 60, 76

[56] References Cited

U.S. PATENT DOCUMENTS

| | | | |
|---|---|---|---|
| 4,827,177 | 5/1989 | Lee et al. | 313/306 |
| 4,956,574 | 9/1990 | Kane | 313/306 |
| 5,124,664 | 6/1992 | Cade et al. | 313/309 X |
| 5,144,191 | 9/1992 | Jones et al. | 313/309 X |
| 5,148,078 | 9/1992 | Kane | 313/309 X |

FOREIGN PATENT DOCUMENTS

WO/91/053-63 4/1991 WIPO .

*Primary Examiner*—Donald J. Yusko
*Assistant Examiner*—Ashok Patel
*Attorney, Agent, or Firm*—Eugene A. Parsons

[57] ABSTRACT

A method of producing an FED including a central conductive region having a surface perpendicular to the supporting structure forming a device anode, a structure including first and second layers of intrinsic semiconductor material with a conductive layer, forming an emitter, sandwiched therebetween and stacked to each provide a surface parallel to and spaced from the conductive region surface, and conductive layers disposed on the provided surfaces of the first and second layers, perpendicular to the sandwiched conductive layer, in spaced relation to each other and the sandwiched conductive layer to form gate extraction electrodes.

7 Claims, 6 Drawing Sheets

FIELD EMISSION DEVICE WITH HORIZONTAL EMITTER

FIELD OF THE INVENTION

The present invention relates generally to cold-cathode field emission devices and more particularly to a method for realizing field emission devices.

BACKGROUND OF THE INVENTION

Field emission devices (FEDs) are known in the art and may be realized using a variety of methods some of which require complex materials deposition techniques and others which require undesirable process steps such as anisotropic etch steps. Typically FEDs are comprised of an electron emitter electrode, a gate extraction electrode, and an anode electrode although two element structures comprised of only an electron emitter electrode and anode are known. In a customary application of an FED a suitable potential is applied to at least the gate extraction electrode so as to induce an electric field of suitable magnitude and polarity such that electrons may tunnel through a reduced surface potential barrier of finite extent with increased probability. Emitted electrons, those which have escaped the surface of the electron emitter electrode into free-space, are generally preferentially collected at the device anode.

Various device geometries which are realized using the known methods include FEDs which emit electrons substantially perpendicularly with respect to a supporting substrate and other FEDs which emit electrons substantially parallel with reference to the supporting substrate. A common shortcoming of the former geometries is that an anode electrode, for collecting electrons, must be provided substantially above the emitting portion of the device. A common shortcoming of the latter geometries is that satisfactory orientation and formation of gate extraction electrodes has heretofore been unrealized.

Accordingly, there is a need for a field emission device and/or a method for forming a field emission device which overcomes at least some of these shortcomings of the prior art.

SUMMARY OF THE INVENTION

This need and others are substantially met through provision of a field emission device comprising a supporting substrate having a generally planar major surface, a selectively formed conductive or semiconductive region supported by the substrate with a surface thereof being disposed generally perpendicular to the major surface of the substrate, a body of material supported on the substrate adjacent the conductive or semiconductive region and further disposed substantially symmetrically about the conductive or semiconductive region, the body including a first layer of intrinsic semiconductor material, a conductive layer, and a second layer of intrinsic semiconductor material stacked to each provide a surface generally parallel to and spaced from the surface of the conductive or semiconductive region, and another layer of conductive material selectively deposited on the provided surfaces of the first layer of intrinsic semiconductor material and the second layer of intrinsic semiconductor material to form spaced apart gate extraction electrodes spaced from and on either side of the conductive layer and disposed generally parallel to and spaced from the surface of the conductive or semiconductive region.

This need and others are further met through a method of forming a field emission device including the steps of providing a selectively formed conductive/semiconductive region, providing a first layer of substantially intrinsic semiconductor material disposed substantially peripherally, distally symmetrically about a part of the conductive/semiconductive region, providing a directionally deposited conductive layer disposed substantially peripherally, distally symmetrically about a part of the conductive/semiconductive region, providing a second layer of substantially intrinsic semiconductor material disposed substantially peripherally, distally symmetrically about a part of the conductive/semiconductive region, and providing another layer of conductive material selectively deposited on exposed portions of the first layer of substantially intrinsic semiconductor material, the second layer of substantially intrinsic semiconductor material, and the selectively formed conductive/semiconductive region, such that a field emission device structure is realized including an electron emitter and a plurality of gate extraction electrodes formed substantially symmetrically, peripherally partially about the selectively formed conductive/semiconductive region which functions as a field emission device anode.

DETAILED DESCRIPTION OF THE PREFERRED EMBODIMENTS

FIGS. 1A through 1K depict a sequence of partial side-elevational, cross-sectional views of structures which may be realized during performance of various steps of a method of forming an embodiment of a field emission device in accordance with the present invention.

Figure 1A:
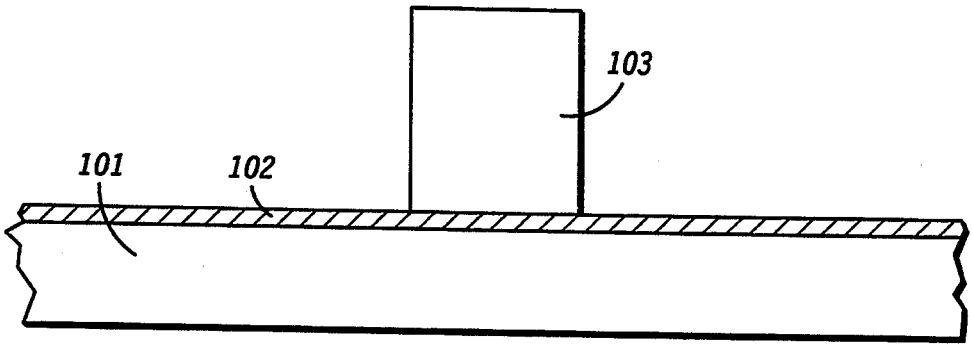
FIGS. 1A–1K are partial side-elevational, cross-sectional views of structures formed at various steps of a method of realizing a field emission device in accordance with the present invention.

Referring now to FIG. 1A there is depicted a supporting substrate 101 having a major surface on which is disposed a selectively patterned first conductive layer 102. A selectively formed conductive or semiconductive region 103 is disposed on selectively patterned conductive layer 102 in a substantially perpendicular manner. Selectively formed conductive or semiconductive region 103 is realized by any convenient method including, for example:

1) depositing, on conductive layer 102, a layer of photoresist material which is subsequently selectively exposed and developed, depositing a layer of conductive or semiconductive material onto any exposed part of conductive layer 102, and removing the photoresist material; or
2) depositing a layer of conductive or semiconductive material on conductive layer 102, depositing a layer of photoresist material which layer is selectively exposed and developed, etching the exposed portions of the layer of conductive or semiconductive material, and then removing the photoresist layer.

Figure 1B:
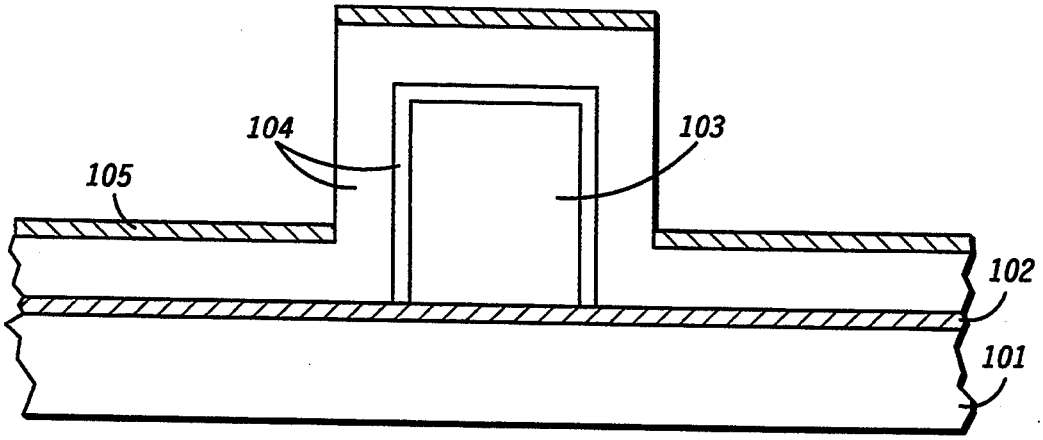

FIG. 1B depicts the structure described previously with reference to FIG. 1A and further comprising a first insulator layer 104 disposed on conductive layer 102 and on exposed surfaces of selectively formed conductive or semiconductive region 103. Insulator layer 104 is produced by providing an initial thermal oxide growth which takes place on the exposed surfaces of selectively formed conductive or semiconductive region 103, followed by deposition of a layer of insulator material. Alternatively, insulator layer 104 may be realized by deposition of a single layer of insulator material such as, for example, silicon-dioxide. A layer 105 of impurity doped semiconductor material is selectively deposited on the horizontal surfaces of insulator layer 104 as shown in FIG. 1B. Because layer 105 is formed of a heavily doped semiconductor material it is a good electrical conductor.

Figure 1C:
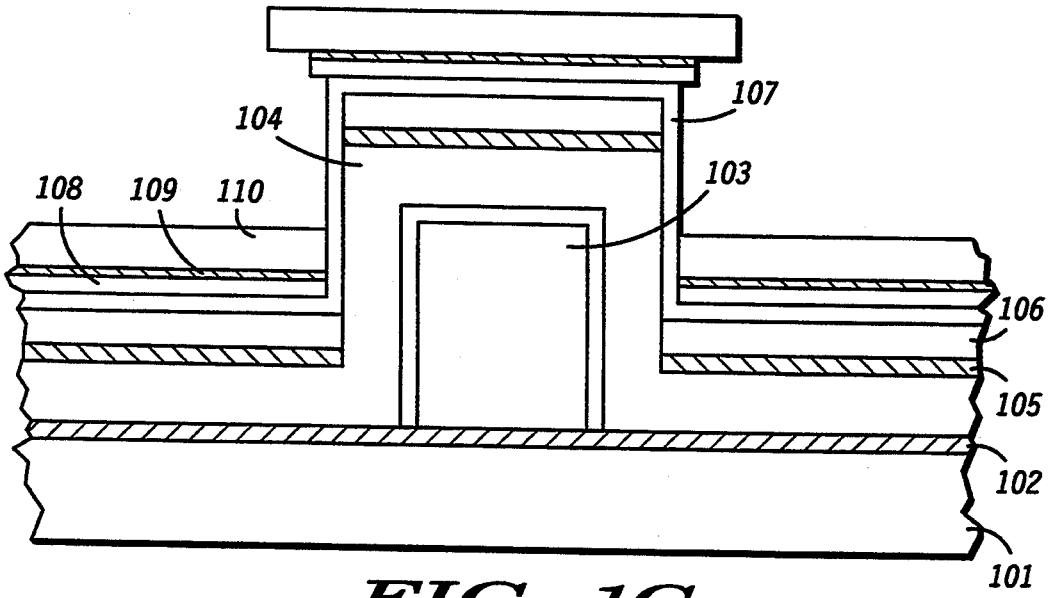

FIG. 1C depicts the structure described previously with reference to FIG. 1B and further comprising a first layer 106 of intrinsic semiconductor material selectively, directionally deposited on layer 105. In this specific embodiment, layer 106 is formed of undoped polysilicon, which is a relatively good insulator. A second insulator layer 107, which is, for example, silicon nitride, is deposited over the surface of the entire structure and an insulator layer 108 is directionally disposed on the horizontal portions of layer 107. In the instance of the field emission device of the present method, as depicted in FIG.1C, insulator layers 107, 108 include:

1) a conformal insulator layer 107 disposed on the surface of layer 106 and on any exposed surfaces of insulator layer 104; and
2) a first selectively directionally deposited layer of intrinsic semiconductor material, for example polysilicon, which is subsequently oxidized to form insulator material 108.

This realization of insulator layer 107, 108 in the described manner is employed to provide a means of protecting a subsequently deposited second conductive layer 109 from a selective deposition, which will be described in more detail presently. Alternatively, if the subsequently deposited conductive layer 109 is of a material which does not induce material deposition during a selective deposition then the multi-step insulator layer 107, 108 need not be employed, in which instance insulator layer 107, 108 may be realized as a single process step.

FIG. 1C further depicts conductive layer 109 disposed on insulator layer 107, 108, wherein conductive layer 109 is selectively directionally deposited. Conductive layer 109 is, for example, a heavily doped polysilicon similar to layer 105 or a metal such as tungsten or the like. An insulator layer 110, which is realized by oxidizing a layer of intrinsic semiconductor material, such as polysilicon, that has been selectively directionally deposited, is disposed on conductive layer 109.

Figure 1D:
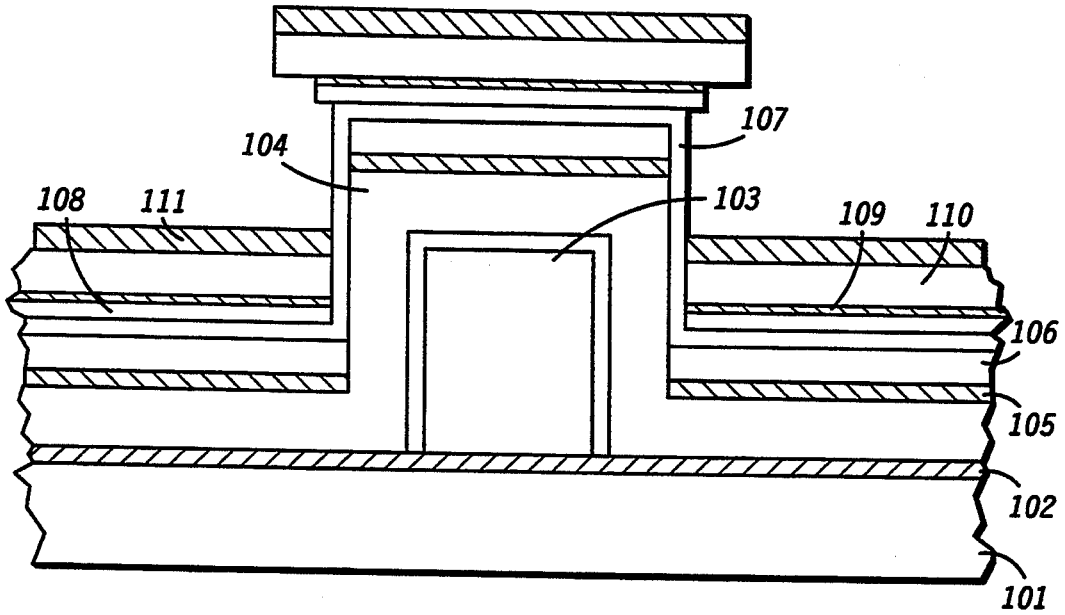
Figure 1E:
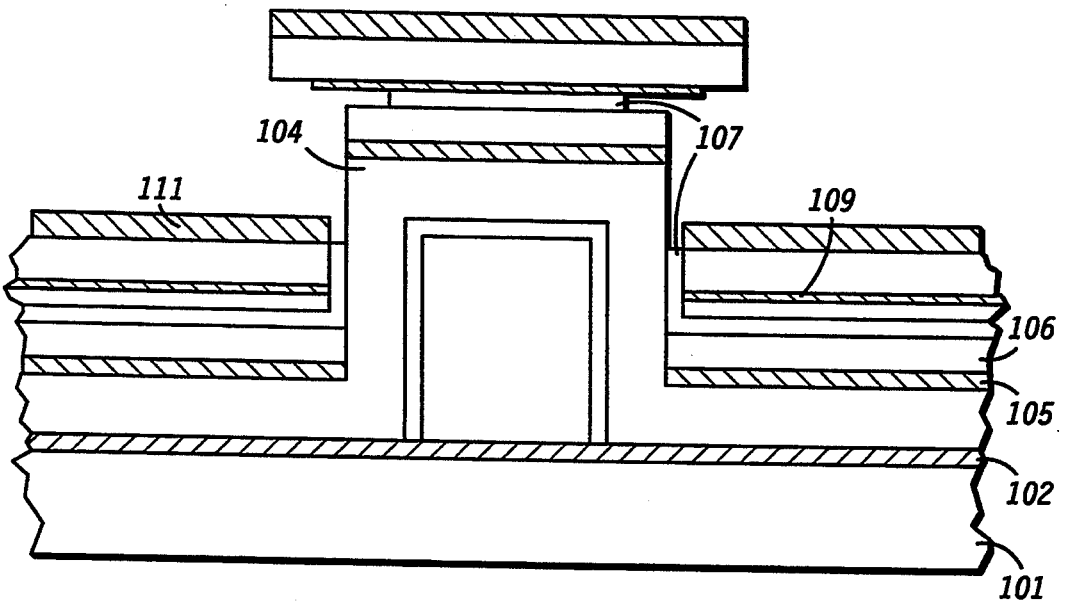

Referring now to FIG. 1D there is depicted a structure of the present method as described previously with reference to FIG. 1C and further including a conductive layer 111 selectively directionally disposed on insulator layer 110. Conductive layer 111 is utilized as a mask for selectively removing portions of conformal insulator layer 107, as illustrated in FIG. 1E. It will be understood that a conductive material, such as a metal or the like, is utilized as conductive layer 111 in this embodiment but any masking material that will protect the structure while allowing the removal of selected portions of layer 107 can be utilized. Part of conformal insulator layer 107 is selectively removed by any of the methods commonly known in the art such as, for example, etching and, once the selected part of conformal insulator layer 107 is removed, conductive layer 111 is removed.

Figure 1F:
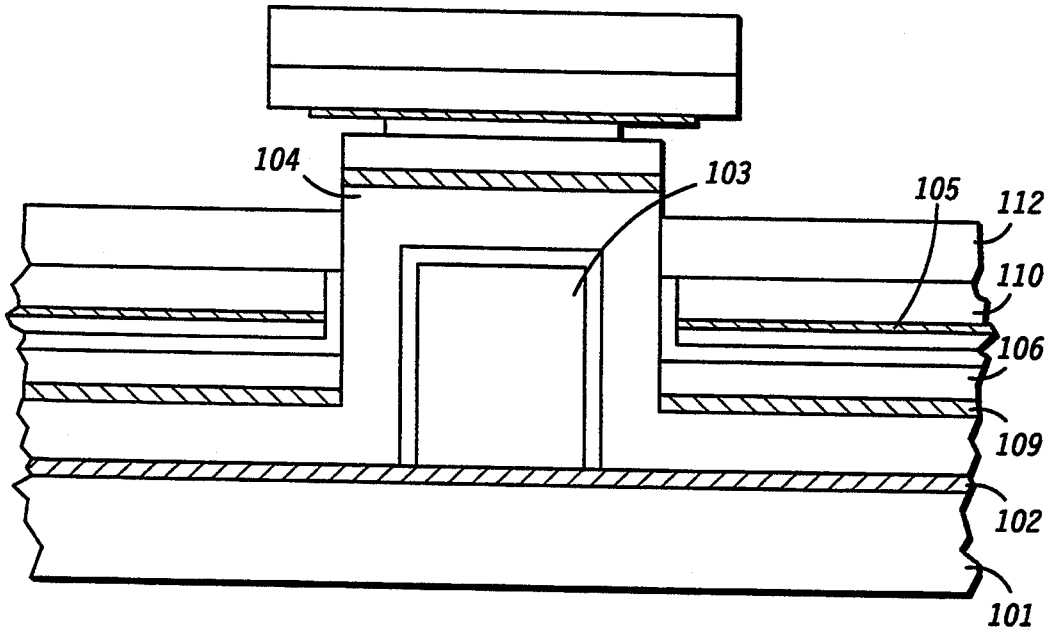
Figure 1G:
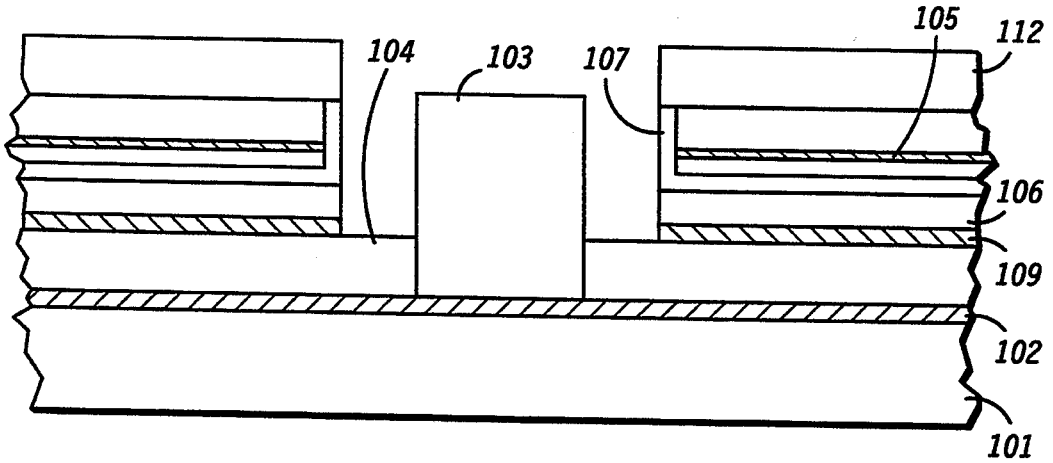

FIG. 1F depicts a structure as described previously with reference to FIG. 1E and further depicting a second layer 112 of intrinsic semiconductor material disposed on insulator layer 110 and wherein the intrinsic semiconductor material is selectively directionally deposited. In this specific embodiment layer 112 is an undoped polysilicon, similar to layer 106, which is a relatively good insulator. Once layer 112 is in place, some of insulator layer 104 is selectively removed such that the opposed perpendicular surfaces of layers 103,106 and 112 are exposed, as illustrated in FIG. 1G.

Figure 1H:
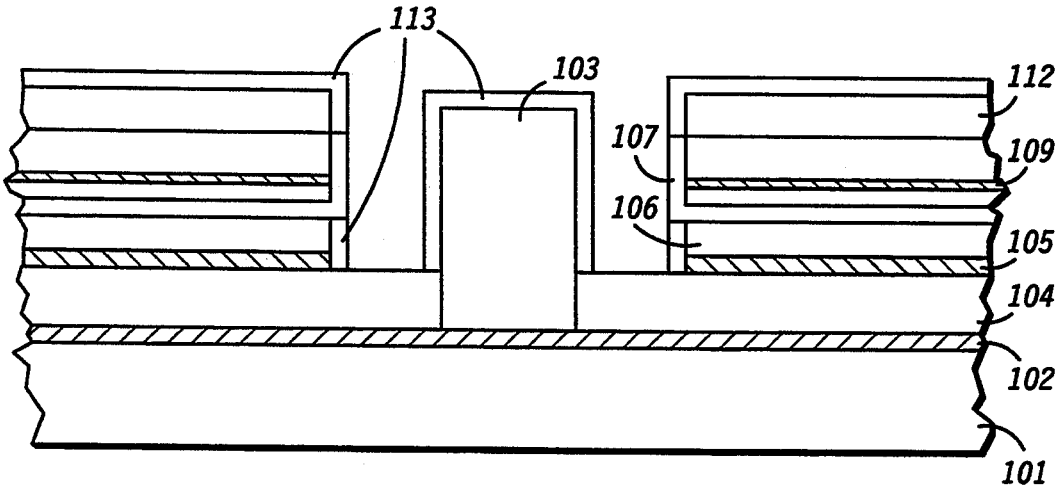

FIG. 1H is a depiction of the structure of the present method as described previously with reference to FIG. 1G and further depicting an oxidized layer 113 having been formed by oxidizing exposed surfaces of intrinsic semiconductor material layers 106 and 112. In the instance when selectively formed conductive or semiconductive region 103 includes semiconductor material the partial oxidation of selectively formed conductive or semiconductive region 103 will take place also, as indicated in FIG. 1H. It is desirable that layer 113 have a thickness substantially equal to the thickness of layer 107. Since oxidation processes can be controlled very closely to provide very accurate thickness of oxidation, an oxidation process is utilized in this embodiment on the surfaces of layers 106 and 112 to provide layer 113.

Figure 1I:
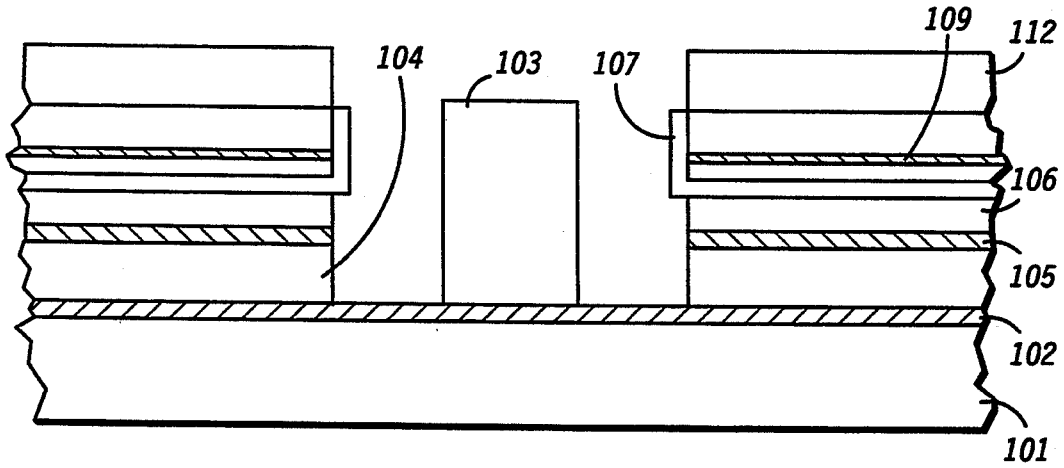

FIG. 1I depicts the structure of the present method as described previously with reference to FIG. 1H and having undergoing a further processing step wherein a selective removal of substantially all of oxidized layer 113 in addition to the part of insulator layer 104 covering conductive layer 102 is realized. By appropriate selection of the material of conformal insulator layer 107 and the material of insulator layers 104 and 113, an etchant which exhibits a high etch discrimination ratio to the two materials is employed such that the material of conformal insulator layer 107 is not removed during the step of selectively removing the oxidized layer 113 and the part of insulator layer 104. As previously mentioned, an appropriate material utilized as conformal insulator layer 107 is silicon nitride and the material of layers 104 and 113 is a silicon dioxide.

Figure 1J:
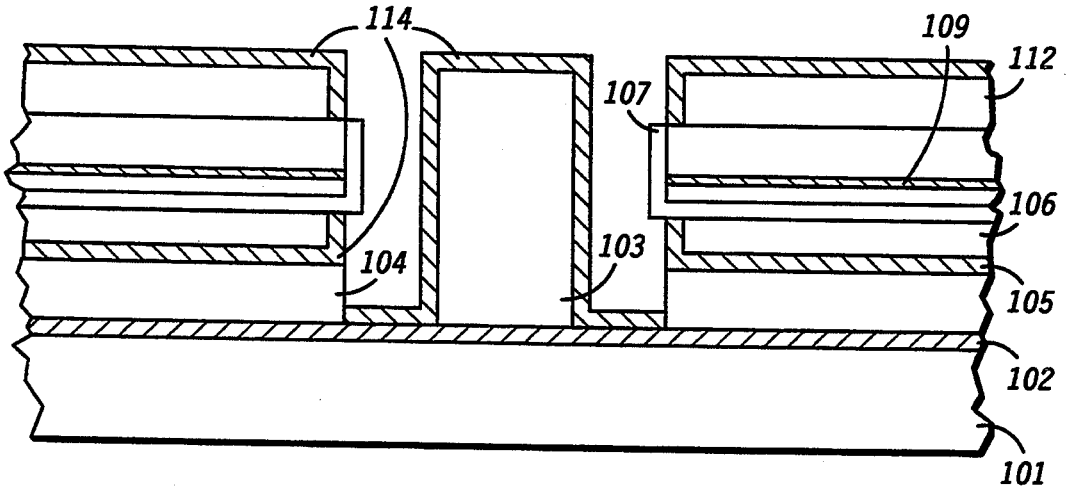

FIG. 1J is a depiction of the structure of the present method as described previously with reference to FIG. 1H and further comprising a selectively deposited third conductive layer 114 disposed on the exposed surfaces of conductive layer 102, layer 106, layer 112 and conductive or semiconductive region 103. Selective deposition of conductive layer 114 is realized by deposition methods known in the art wherein a conductive material employed in the deposition such as, for example, tungsten preferentially deposits onto conductive and semiconductor materials and not onto insulator materials such as, for example, silicon dioxide and silicon nitride. In the instance of the present method the selective deposition of conductive layer 114 onto layers 106 and 112 of intrinsic semiconductor material provides for a region wherein conductive layer 114 is substantially perpendicular to conductive layer 109. Further, by removing the correct amount of layers 106 and 112 with the formation and removal of layer 113, the perpendicular portions of conductive layer 114 are positioned approximately in a plane or line with the inner extremity of conductive layer 109. It is of interest for the formation of the FED that the region wherein the perpendicular part of conductive layer 114 be disposed substantially at the same radial distance, with respect to conductive or semiconductive region 103, as is the nearest limit of the extent of conductive layer 109.

Figure 1K:
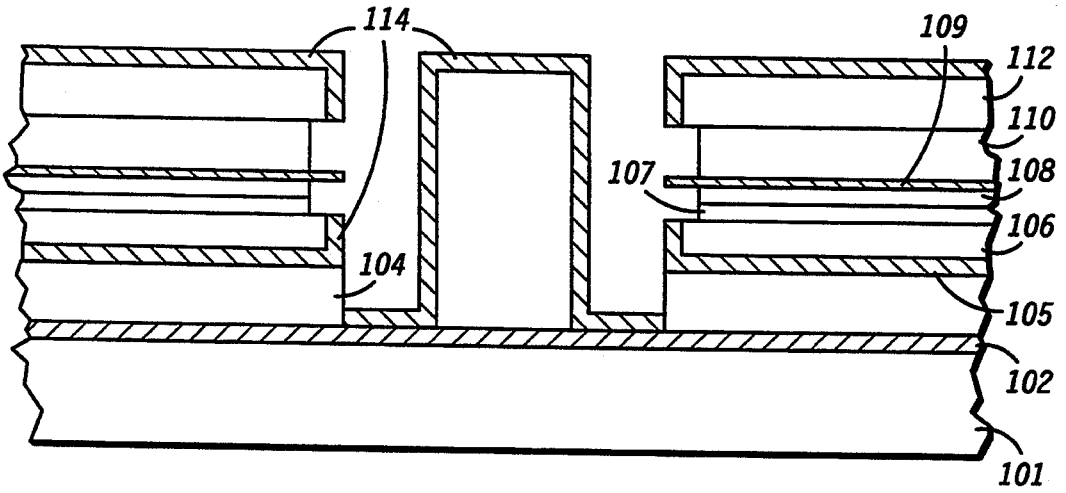

Referring now to FIG. 1K there is depicted a structure as described previously with reference to FIG. 1J and further depicting that the remaining part of conformal insulator layer 107 and portions of insulator layers 108 and 110 are selectively removed to the extent that the inner extremity of conductive layer 109 is exposed. It will be noted that layer 107 is retained in position over the inner extremity of conductive layer 109 until after the formation of conductive layer 114. Because conductive material is selectively deposited on all exposed conductive or semiconductive surfaces in a manner to form conductive layer 114, if conductive layer 109 is exposed a build-up of conductive material will occur on the inner extremity thereof. This build-up of conductive material will greatly reduce the operating characteristics of the FED. It should be understood, however, that conductive layer 109 might be constructed of a material on which conductive layer 114 will not be deposited, in which case several of the steps of the present process designed to form and retain layer 107 over the inner extremity of conductive layer 109 may not be required.

In accordance with the method previously described and depicted in FIGS. 1A–1K an FED is formed wherein conductive layer 109 functions as an electron emitter electrode, portions of conductive layer 114 formed on layers 106 and 112 function as a plurality of gate extraction electrodes, and the portion of conductive layer 114 covering conductive or semiconductive region 103 in concert with conductive layer 102 function as a device anode.

Formation of the FED in accordance with the method previously described provides for substantially symmetric, peripheral, distal disposition of each of the component elements of the FED at least partially about the selectively formed conductive or semiconductive region 103 including the substantially peripheral, symmetric, distal disposition of:

1) layer 105 of impurity doped semiconductor material,
2) conductive layer 109, and
3) layers 106 and 112 of intrinsic semiconductor material on which is selectively disposed conductive layer 114.

Application of suitable externally provided potentials to the electrodes and device anode of the FED described will provide for electron emission from the electron emitter electrode.

It should be noted that layers 106 and 112 are formed of semiconductor material so that conductive layer 114 can be deposited thereon. However, it is important that layers 106 and 112 be relatively good insulators to provide the maximum amount of electrical separation between layer 109, which forms the electron emitter electrode, and layer 114, which forms the gate extraction electrode while providing relatively close physical spacing between the inner extremities of layer 109 and layer 114. This reduces, or minimizes, the amount of internal leakage of the FED and improves the operation.

Formation of part of the gate extraction electrodes with a substantially perpendicular orientation with respect to the electron emitter electrode provides for an improvement in the electric field enhancement in the region of the electron emitter electrode which enhancement is a desirable feature of FED operation.

Figure 2:
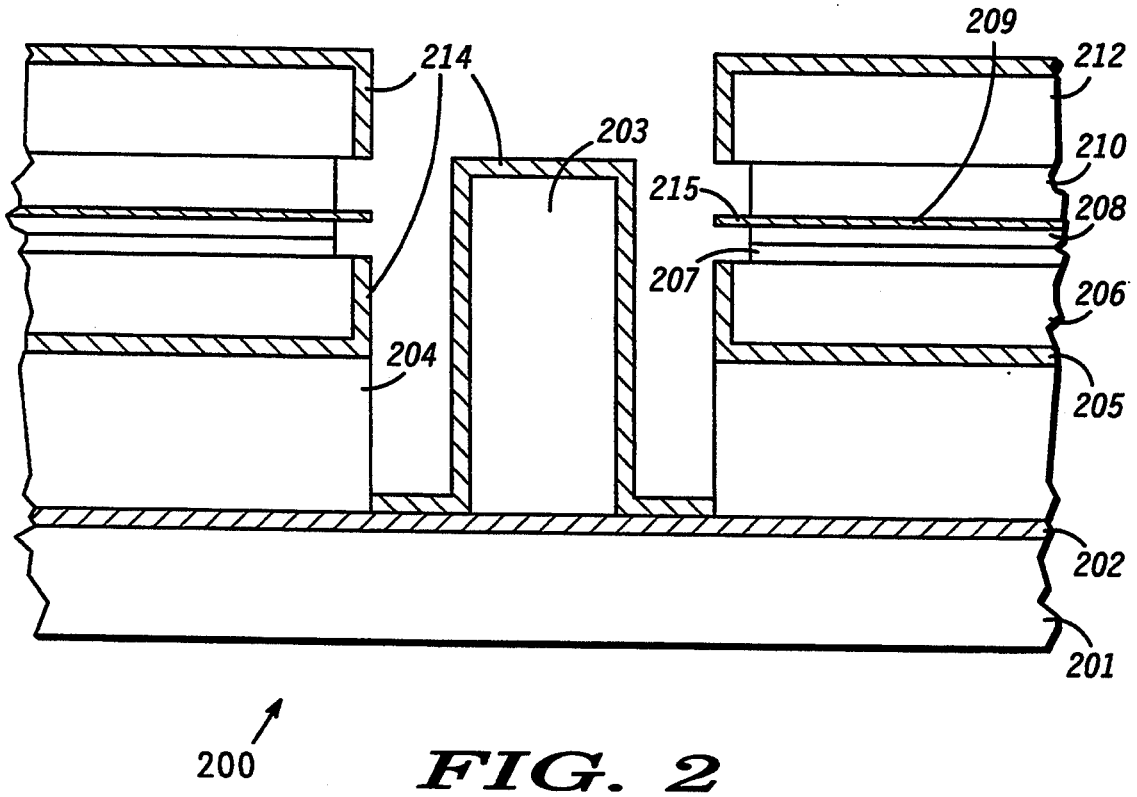
FIG. 2 is a partial side-elevational cross-sectional depiction of another embodiment of a field emission device in accordance with the present invention.

Referring now to FIG. 2 there is depicted a partial side-elevational cross-sectional view of a field emission device 200. FED 200 is another embodiment constructed in accordance with the present invention as described previously with reference to FIG. 1A–1K, wherein similar components are designated with similar numbers having a "2" prefix to indicate a different embodiment. FED 200 is illustrated to identify a first electron emitting edge 215 associated with the inner extent of a conductive layer 209. The inner extent of conductive layer 209 is defined by implementing the various steps of the method of the present invention previously described. By providing a prescribed thickness of conductive layer 209 the radius of curvature of electron emitting edge 215 is substantially determined. For example, depositing conductive layer 209 with a thickness of 1000 angstroms provides an electron emitting edge with a radius of curvature generally not in excess of 500 angstroms. Similarly, thinner conductive layers 209 will provide corresponding reductions in the radius of curvature of electron emitting edge 215. It is known in the art that field-induced electron emission is a strong inverse function of the radius of curvature of the electron emission structure.

FIG. 2 further depicts that the gate extraction electrodes, which include perpendicular portions of layer 214, are symmetrically, perpendicularly disposed about electron emitting edge 215. An electric field is induced at electron emitting edge 215 by applying externally provided potentials/signals to the plurality of gate extraction electrodes through connecting layer 205 (for the lower gate extraction electrode) and layer 214 (for the upper gate extraction electrode). This novel disposition of the gate extraction electrodes and the electron emitter establishes a means for providing an induced electric field at the electron emitting edge 215 of the electron emitter electrode which is substantially optimally enhanced and symmetric.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What we claim is:

1. A field emission device comprising:

a supporting substrate having a planar surface;

a selectively patterned first conductive layer formed on the surface of the supporting substrate;

a device anode, including a region formed of one of a conductive and semiconductive material, disposed on the first conductive layer and substantially perpendicular thereto;

a plurality of stacked insulating layers having a second conductive layer disposed therebetween, the stacked insulating layers being supported on the surface of the substrate, wherein the second conductive layer is further disposed substantially peripherally, symmetrically, distally, at least partially about the device anode and wherein the second conductive layer provides an edge spaced from the device anode and operating as an electron emitter; and a plurality of gate extraction electrodes including a layer of conductive material selectively deposited on two different insulating layers of the plurality of stacked insulating layers and disposed substantially peripherally, symmetrically, distally, at least partially about the device anode, wherein each of the plurality of gate extraction electrodes is substantially electrically isolated from the electron emitter by an insulating layer of the plurality of stacked insulating layers and at least some of the plurality of insulating layers on which the layer of selectively deposited conductive material is disposed include substantially intrinsic semiconductor material.

2. A field emission device comprising:

a supporting substrate having a major surface;

a first selectively patterned conductive layer disposed on the major surface of the supporting substrate;

a device anode, including a selectively formed region including one of a conductive and a semiconductive material, disposed on the first conductive layer;

a first insulator layer disposed on exposed parts of the first conductive layer;

a layer of impurity doped semiconductor material disposed on the first insulator layer and further disposed substantially peripherally, distally symmetrically about a part of the device anode;

a first layer of substantially intrinsic semiconductor material disposed on the layer of impurity doped semiconductor material and further disposed substantially peripherally, distally symmetrically about the device anode;

a second insulator layer disposed on the first layer of substantially intrinsic semiconductor material;

a device emitter including a second conductive layer disposed on the second insulator layer and further disposed substantially peripherally, distally symmetrically about a part of the device anode;

a third insulator layer disposed on the second conductive layer;

a second layer of substantially intrinsic semiconductor material disposed on the third insulator layer and further disposed substantially peripherally, distally symmetrically about a part of the device anode; and a third layer of conductive material selectively deposited on the first conductive layer, the first layer of substantially intrinsic semiconductor material, the second layer of substantially intrinsic semiconductor material, and the selectively formed region, a portion of the third layer of conductive material operating as a gate extraction electrode.

3. The field emission device of claim 2 wherein the third layer of selectively deposited conductive material is tungsten.

4. A field emission device comprising:

a supporting substrate having a generally planar major surface;

a device anode, including a selectively formed region including one of a conductive and semiconductive material, supported by said substrate with a surface thereof being disposed generally perpendicular to the major surface of said substrate;

a plurality of layers of materials supported on said substrate adjacent said device anode and further disposed substantially symmetrically about said device anode, said plurality of layers of materials including a first layer of intrinsic semiconductor material, a conductive layer, and a second layer of intrinsic semiconductor material stacked to each provide a surface generally parallel to and spaced from the surface of said device anode, the surface of the conductive layer operating as an emitter; and another layer of conductive material selectively deposited on the provided surfaces of said first layer of intrinsic semiconductor material and said second layer of intrinsic semiconductor material to form spaced apart gate extraction electrodes spaced from and on either side of said conductive layer and disposed generally parallel to and spaced from the surface of said device anode.

5. The field emission device of claim 4 wherein the first and second layers of intrinsic semiconductor material include polysilicon.

6. The field emission device of claim 4 wherein the another layer of conductive material includes tungsten.

7. A field emission device comprising:

a supporting substrate having a planar surface;

a selectively patterned first conductive layer formed on the surface of the supporting substrate;

a device anode, including a region formed of one of a conductive and semiconductive material, disposed on the first conductive layer and substantially perpendicular thereto;

a plurality of stacked insulating layers having a second conductive layer disposed therebetween, the stacked insulating layers being supported on the surface of the substrate, wherein the second conductive layer is further disposed substantially peripherally, symmetrically, distally, at least partially about the device anode and wherein the second conductive layer provides an edge spaced from the device anode and operating as an electron emitter; and a plurality of gate extraction electrodes including a layer of conductive material selectively deposited on two different insulating layers of the plurality of stacked insulating layers and disposed substantially peripherally, symmetrically, distally, at least partially about the device anode, wherein each of the plurality of gate extraction electrodes is substantially electrically isolated from the electron emitter by an insulating layer of the plurality of stacked insulating layers and wherein a first part of each of the plurality of gate extraction electrodes are selectively, perpendicularly, symmetrically disposed at least partially about the electron emitter edge and a second part of each of the plurality of gate extraction electrodes are disposed between adjacent insulating layers and substantially perpendicular to the first part, each gate extraction electrode being formed with the first part electrically connected to the second part and the second part forming an electrical connection for applying electrical potentials to the first part.

* * * * *